United States Patent [19]

Robles

[11] 4,162,228

[45] Jul. 24, 1979

[54] PROCESS FOR PREPARING COLORED DETERGENT FLAKES

[75] Inventor: Enrique C. Robles, Madrid, Spain

[73] Assignee: Lever Brothers Company, New York, N.Y.

[21] Appl. No.: 910,818

[22] Filed: May 30, 1978

[30] Foreign Application Priority Data

May 31, 1977 [GB] United Kingdom ..... 22948/77

[51] Int. Cl.[2] ..... C11D 1/66; C11D 3/40; C11D 11/00; C11D 17/06

[52] U.S. Cl. ..... 252/90; 8/79; 252/89.1; 252/91; 252/174; 252/DIG. 1; 427/180; 427/212; 428/403

[58] Field of Search ..... 8/77, 78, 79, 93; 252/DIG. 1, 89, 90, 91, 134, 174; 427/180, 212; 428/403

[56] References Cited

U.S. PATENT DOCUMENTS

| | | | |
|---|---|---|---|
| 2,997,362 | 8/1961 | Baumann | 8/93 |
| 3,553,139 | 1/1971 | McCarty | 252/95 |
| 3,592,254 | 7/1971 | Bauer | 159/4 |
| 3,679,610 | 7/1972 | Sams | 252/529 |
| 4,069,013 | 1/1978 | Hett | 8/79 |

FOREIGN PATENT DOCUMENTS

| | | | |
|---|---|---|---|
| 577479 | 6/1959 | Canada | 252/90 |
| 1050127 | 12/1966 | United Kingdom | 252/109 |

*Primary Examiner*—Dennis L. Albrecht
*Attorney, Agent, or Firm*—Melvin H. Kurtz

[57] ABSTRACT

The present invention provides a process for making colored nonionic detergent flakes, which is characterized in that nonionic detergent flakes are mixed with a dry, powdered coloring agent in a mixing apparatus.

4 Claims, No Drawings

PROCESS FOR PREPARING COLORED DETERGENT FLAKES

The present invention relates to a process for preparing coloured detergent flakes. More particularly it relates to a process for preparing coloured nonionic detergent flakes, in which a nonionic detergent in flake-form is admixed with a colouring agent.

Colouring of detergent particles is well-known. Commonly used processes include spraying an aqueous solution of a colouring agent on to detergent particles, or homogeneously dispersing a colouring agent into a slurry of a detergent composition and spray-drying the same, or homogeneously dispersing a colouring agent into a detergent, and forming particles therefrom, e.g. noodles, which are coloured through and through. Another known method consists of spraying a solution of a colouring agent in a nonionic/water system on to granular sodium tripolyphosphate.

All these processes require careful operation conditions, such as the proper dispersion of the colouring agents, and also require a subsequent granulation or particle-forming step, e.g. spray-drying, noodling and the like. As often the coloured particles are added to a particulate detergent powder to obtain a speckled detergent composition, such separate preparation of coloured particles may entail extra costs as well as apparatuses. Another disadvantage is that the coloured speckles, obtained by some of these processes, are rather fragile, and break down easily during the handling by attrition forces.

It has now been found that coloured detergent particles can be obtained by a simple process, which comprises simply mixing detergent flakes with dry, powdered colouring agents in a suitable mixing apparatus Surprisingly, the dry powdered colouring agent is uniformly distributed on the surface of the flakes, and does not bleed out or otherwise come loose from the flakes to any significant degree.

The detergent flakes consist of flakes of a nonionic detergent, and the present invention therefore provides a process for making coloured nonionic detergent flakes, which is characterized in that nonionic detergent flakes are mixed with dry, powdered colouring agent in a mixing apparatus. The nonionic detergent flakes are flakes from a nonionic detergent having a softening point of at least not below 30° C., preferably not below 40° C. The flakes should be not too hard, since they would then not readily absorb the colouring agent. The softening point should therefore be below 70° C., preferably below 60° C.

Nonionic detergents are usually alkylene oxide condensation products, obtained by condensing primary or secondary $C_{10}$–$C_{18}$ alcohols, $C_9$–$C_{18}$ alkyl phenols, polyethylene glycols, $C_{10}$–$C_{18}$ fatty acids, $C_{10}$–$C_{18}$ fatty acid amides and so on with 1–35 moles of an alkylene oxide, such as ethylene, propylene and butylene oxide, and mixtures thereof. Depending on the amount of moles of alkylene oxide and the carbon chain length of the hydrophobic radial of the nonionics, they are obtained as liquids, pastes or solids. The nonionic detergent of the invention belong to the last class, i.e. they are obtained in solid form, from which flakes can be prepared by a suitable flaking operation on a roller. Such nonionic flakes are commercially available, e.g. flakes of a $C_{16}$–$C_{18}$ linear synthetic alcohol, condensed with 23 moles of ethylene oxide, having a softening point of 39°–40° C. Other examples of suitable nonionic detergents in flake-form are $C_{16}$–$C_{18}$ linear alcohols, condensed with 25 moles of ethylene oxide or with 35 moles of ethylene oxide.

The flakes may contain small amounts of other ingredients, such as anti-oxidants, perfumes, soil-suspending agents, soil-release agents, enzymes and so on, as long as the softening point of the flakes remains at least not below 30° C. Since the flakes of the invention are above all suitable for incorporation into detergent powders, the nonionic detergent should not interfere with, but should contribute to the detergency of the final detergent composition, both in machine- and in bowl-washing.

The dry, powdered colouring agent, used in the present invention, may be of any suitable type, as long as it is present in a dry, powdered form. It may have any colour e.g. blue, yellow, green, red and so on. Typical examples are Indigo Blue AC7, Colour Index C1 73000 (Vat blue no. 1), Indigotine or Aniline Carmin Blue AC, 8 Colour Index 73015 (Acid Blue 74 or Food Blue 1), Azul Iragón (Colour Index 74.160) etc.

The dry, powdered colouring agent should be of a sufficiently low particle size; in general the particle size must be from 1–10, preferably 5–6 micron.

The amount of dry, powdered colouring agent used in the present invention ranges from 0.01–5%, preferably from 0.1–2% by weight, based on the total composition, i.e. flakes plus colouring agent.

The mixing of the flakes and colouring agent may take place in any suitable mixing apparatus at room temperature. Normally, the mixing period is relatively short, i.e. in the order of 10–15 minutes, depending of course upon the amounts to be mixed and the capacity and efficiency of the mixing apparatus.

The coloured flakes prepared according to the invention may be added to other detergent compositions, e.g. spray-dried particulate detergent compositions, thus providing so-called speckled detergent compositions. In general, the coloured flakes are added to such detergent compositions in an amount of 0.1–10%, preferably 0.5–5% by weight.

The invention will further be illustrated by way of Example.

EXAMPLE I

Flakes of a nonionic detergent ($C_{16}$–$C_{18}$ linear primary alcohol, condensed with 23 moles of ethylene oxide; softening point 39°–40° C.) were added to a Grüber mixer and under agitation a powdered dry colouring agent, Indigo Blue, particle size 5–6 micron was added. The amount of flakes was 198 kg, and the amount of colouring agent was 2 kg.

The mixing was continued for 15 minutes at ambient temperature.

Uniformly coloured flakes were obtained, which on storage at ambient temperatures and at 40° C. did not show any bleeding-out of the colouring agent to any significant degree. When added to a particulate spray-dried detergent composition in an amount of 1.5%, a speckled detergent composition was obtained, in which the coloured flakes on storage did not deteriorate.

EXAMPLE II 1.98 kg of the nonionic detergent flakes of Example I were admixed with 0.02 kg of the same colouring agent as in Example I in a 10 liter eccentric mixer for 10 minutes. Satisfactory, coloured flakes were obtained, which were added to a spray-dried detergent composition in an amount of 1.5% and 3%. The speckled detergent compositions thus obtained were stored at ambient temperature and at 40° C. Only at the 3% level of coloured flakes at 40° C. some transport of the dyestuff to the detergent base powder was observed, which however disppeared on prolonged storage.

EXAMPLE III

Example I was repeated, using 200 kg of the nonionic detergent flakes, 0.09 kg Iragon Blue (particle size 5 micron) and 0.13 kg Polar Blue GAW (particle size 5 micron).

I claim:

1. A process for preparing coloured detergent particles, in which nonionic detergent flakes with a softening point of between 30° and 70° C. are admixed with a dry, powdered colouring agent, having a particle size of 1–10 micron, said colouring agent being used in an amount of 0.01–5% by weight of the total of nonionic detergent flakes and colouring agent.

2. A process according to claim 1, in which 0.1–2% by weight of the colouring agent is used.

3. A process according to claim 1, in which the colouring agent has a particle size of 5–6 micron.

4. A process according to claim 1, in which the coloured nonionic detergent flakes are added in an amount of 0.1–10% by weight to a particulate detergent base powder to produce a speckled detergent composition.

* * * * *